United States Patent [19]

McCallister

[11] 4,141,396

[45] Feb. 27, 1979

[54] HYDRAULIC LOG SPLITTER

[76] Inventor: James J. McCallister, Mayer Thorpe, Alberta, Canada

[21] Appl. No.: 832,597

[22] Filed: Sep. 12, 1977

[51] Int. Cl.[2] ..... B27L 7/00

[52] U.S. Cl. ..... 144/193 A; 144/194

[58] Field of Search ..... 144/3 K, 193 R, 193 A, 144/194, 193 E, 323; 254/104

[56] References Cited

U.S. PATENT DOCUMENTS

| | | | |
|---|---|---|---|
| 2,105,215 | 1/1938 | Dinzl | 144/193 R |
| 2,356,324 | 8/1944 | Kendle et al. | 144/194 |
| 2,851,072 | 9/1958 | Gerjets et al. | 144/193 A |
| 3,319,675 | 5/1967 | Bles, Sr. | 144/193 A |
| 3,356,115 | 12/1967 | Cole | 144/193 R |
| 3,862,651 | 1/1975 | Heikkinen | 144/193 A |
| 3,938,567 | 2/1976 | Dircksen | 144/193 A |
| 3,995,672 | 12/1976 | Binninger | 144/193 A |

*Primary Examiner*—Othell M. Simpson
*Assistant Examiner*—W. D. Bray
*Attorney, Agent, or Firm*—Howard I. Podell

[57] ABSTRACT

A self-contained, or externally actuated, hydraulic log splitter which includes a frame on which is slidably mounted an assembly of a push plate secured at one end to a reversible hydraulic cylinder and at the other to a splitting table carrying logs which is pushed against a straight blade to split the logs. A square steel bar is fixed centrally on the push plate along its entire height to provide in-line thrust at all times even when the ends of the logs are uneven. A gas engine or the hyraulic system of a tractor are connected to a pump mounted on one side of the frame to provide power to the cylinder. Elevated guide rails are fixed to the sides of the table to retain the logs. A hydraulic control valve allows movement only as long as it is operated.

6 Claims, 6 Drawing Figures

HYDRAULIC LOG SPLITTER

FIELD OF THE INVENTION

This invention relates generally to a mobile, hydraulic splitting machine for splitting logs.

STATEMENT OF THE PRIOR ART

The prior art, as exemplified by U.S. Pat. Nos. 3,077,214; 3,760,854; 3,280,864; 3,319,675 and 2,656,195 is generally illustrative of various devices of this type. While such devices are generally illustrative and acceptable for their intended purpose, they have not proven to be entirely satisfactory in that they are either complex and expensive to manufacture, or bulky and inconvenient to use, or require unusual skill and/or dexterity to operate. As a result of the shortcomings of the prior art, typified by the above, there has developed and continues to exist a substantial need for devices of the character described. Despite this need, and the efforts of many individuals and companies to develop such devices, a satisfactory device meeting this need has heretofore been unavailable.

The principal object of this invention is to provide a device or article of this character which combines simplicity, strength and durability in a high degree, together with inexpensiveness of construction.

Other objects of this invention will in part be obvious and in part hereinafter pointed out.

SUMMARY OF THE INVENTION

This invention resides in a self-contained, or externally actuated, hydraulic log splitter which includes a frame on which is slidably mounted an assembly of a push plate secured at one end to a reversible hydraulic cylinder and at the other to a splitting table carrying logs which is pushed against a straight blade to split the logs. A square steel bar is fixed centrally on the push plate along its entire height to provide in-line thrust at all times even when the ends of the logs are uneven. A gas engine or the hydraulic system of a tractor are connected to a pump mounted on one side of the frame to provide power to the cylinder. Elevated guide rails are fixed to the sides of the table to retain the logs. A hydraulic control valve allows movement only as long as it is operated.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENT

Figure 1:
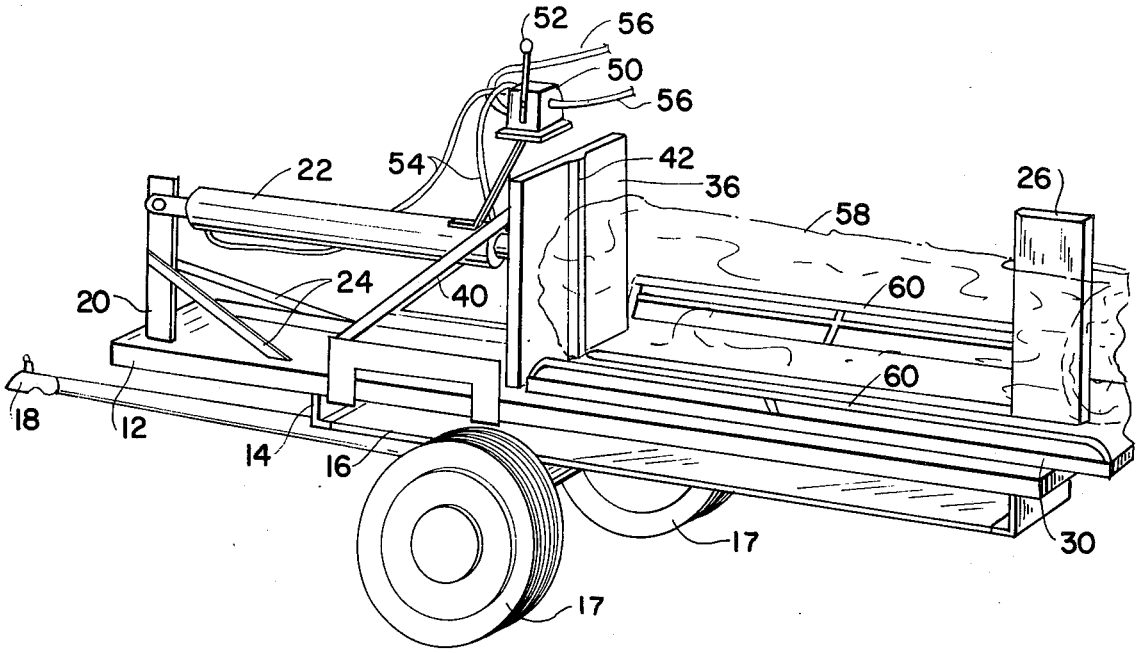
FIG. 1 is a perspective view of an embodiment of the invention designed to be mounted on a tractor.
Figure 2:
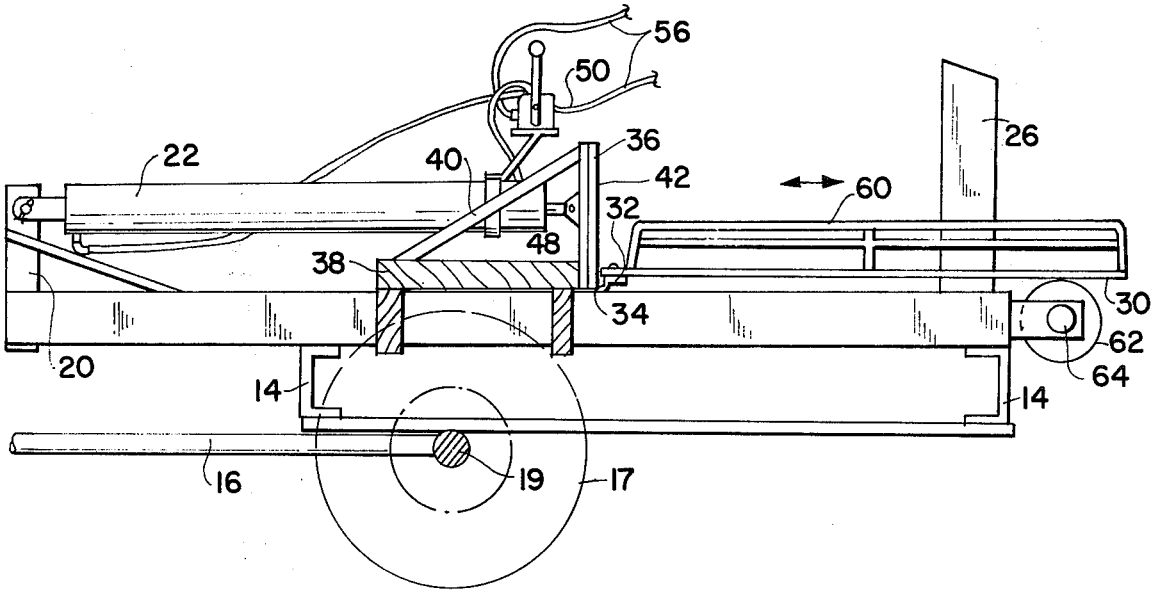
FIG. 2 is a side view thereof.

With reference to the drawing, there is shown and illustrated a LOG SPLITTER constructed in accordance with the principles of the invention and designated generally by reference character 10.

The log splitter 10 includes a frame 12 which can be constructed of channel iron. Secured underneath the frame by angle irons 14 is a sub-frame assembly 16 to which wheels 17 on axle 19 are fixed. Instead of wheels, a 3-point hitch 21 or trail or mount can be secured to the sub-frame (FIG. 3).

Bracket 20 is welded or otherwise fixed to one end of frame 12 and supports one end of hydraulic cylinder 22. Braces 24 are welded to bracket 20 and to frame 12 to give greater solidity to the assembly.

A vertical, straight, blade 26 about ½ inch thick is welded to the other end of frame 12. Unlike prior art, splitting blades which are generally wedge-shaped, this straight blade does not split logs so they will fall to the ground and become wet of dirty. Another advantage afforded by a thin, straight blade is that it splits smoothly through knots in the logs and tough cuts of wood.

Figure 3:
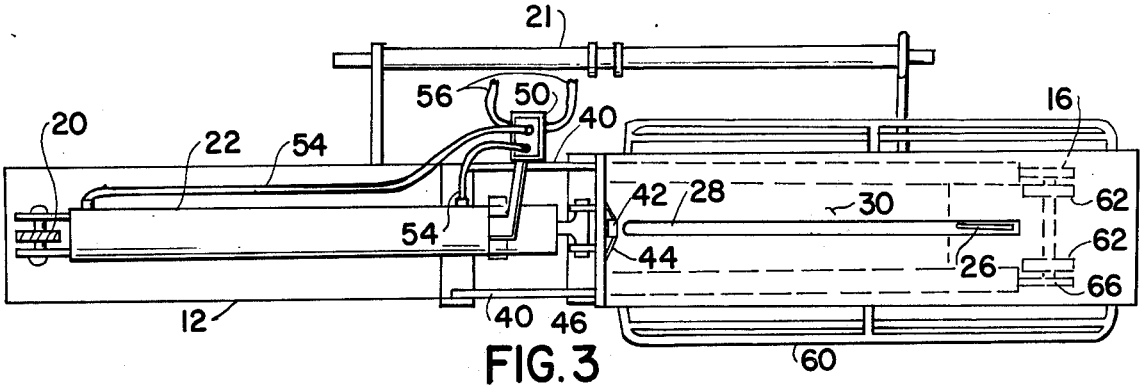
FIG. 3 is a top plan view of the same with wheels replaced by a hitch.
Figure 4:
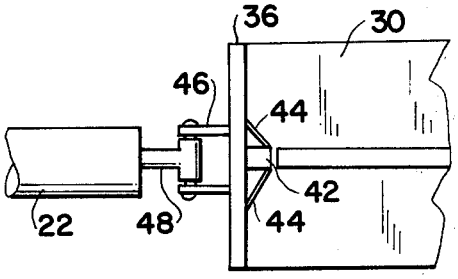
FIG. 4 is a detailed plan view showing attachment of the cylinder to the push plate.
Figure 6:
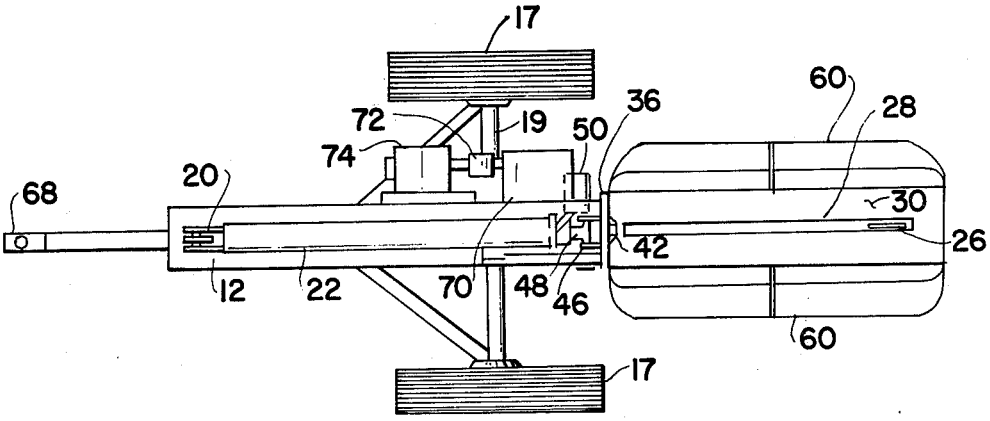
FIG. 6 is a top plan view of a self-contained version of the invention for use behind a car, truck or snowmobile.

As shown in greater detail in FIGS. 3 and 6, blade 26 fits in a blade clearance, elongated slot 28 in moving table 30 which consists of a metal or hardwood plate. Table 30 is secured by bolts 32 and plates 34 on each side of vertical push plate 36 secured to one end of a slide assembly 38 movable on frame 12. Assembly 38 has braces 40 fixed thereto and to metal or wood push plate 36 for reinforcement. Push plate 36 preferably is only ¾ as high as blade 26. On its side facing blade 26, push plate 36 has a 1 inch square steel bar 42 of the same height as plate 36 secured thereto by welded strap irongs 44 (FIG. 4).

A fork 46 is secured to push plate 36 and is connected to the end of rod 48 of reversible hydraulic cylinder 22.

A hydraulic control valve 50, actuated by push-pull rod 52, is connected via hoses 54 to cylinder 22. Hoses 56 connect valve 50 to the fluid drive of the tractor. Valve 50 is of the positive type in that it allows fluid to pass only when the operator actuates the push-pull rod, to apply and remove hydraulic pressure. The movement of the cylinder pushing the push plate and hence logs 58 against blade 26 can be very slow making the machine safe to use. A typical splitting cycle is 10 to 12 seconds.

Retaining sides 60 made of ½ inch steel rods are mounted at an angle to table 30. As a result of this arrangement, once a log is placed on table 30, it can stay there during one or several splitting cycles. Accordingly, logs can be put through the blade several times with no split logs falling to the ground. Also noteworthy is the fact that the smaller logs, 2 or 3, can be stacked to go through with one stoke of the push plate. Advantageously, the split logs all remain on table 30 behind the blade when the push plate has reached its full travel so they can be removed in one neat bundle.

Figure 5:
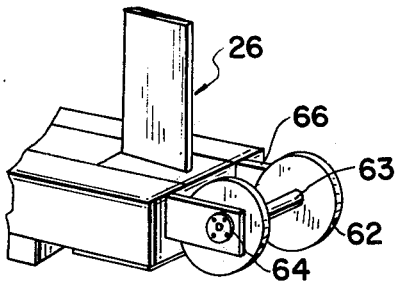
FIG. 5 is a detailed perspective view of the end assembly.

A preferred arrangement for the rear section of table 30 is shown in FIG. 5, where rollers 62 welded to a shaft 63 on sealed bearing 64 are mounted on supports 66 welded to frame 12. As shown, the bottom of table 30 passes over the rollers.

FIG. 6 shows a self-contained version of the splitter of the invention which differs from the previous embodiment by being mounted on hitch frame 68; by having oil tank 70 connected to hydraulic pump 72 and has gan engine 74 operatively associated with pump 72.

Control valve 50 regulates flow of hydraulic fluid from the pump 72 to hydraulic cylinder 22. The assembly can be attached to a truck or snowmobile and can be operated without unhooking it from the towing vehicle. Additionally, by attaching the assembly to the tractor drawbar, the splitter can be raised to the proper height above the ground so that the operator does not have to work stooped over.

A typical model of the present splitter equipped with a hydraulic system with a 13 G.P.M. hydraulic pump can split 4 logs per minute.

The operation and use of the invention hereinabove described will be evident to those skilled in the art to which it relates from a consideration of the foregoing.

It will thus be seen that there is provided a device in which the several objects of this invention are achieved, and which is well adapted to meet the conditions of practical use.

As various possible embodiments might be made of the above invention, and as various changes might be made in the embodiments above set forth, it is to be understood that all matter herein set forth or shown in the accompanying drawing is to be interpreted as illustrative and not in a limiting sense.

Having thus described my invention I claim as new and desire to secure by Letters Patent:

1. A log splitter comprising a frame; a straight splitting blade fixed vertically to one end of said frame; a table member adapted to support logs to be split, said table member being slidably mounted on said frame; said table member having an elongated blade clearance slot therein; log-abutment means fixed to said table and adapted to push one end of the log on said table so as to engage the opposite end against said blade; power transfer means operatively connected to said abutment means to reciprocally move same to force said log through said blade; and retaining means on each side of said table extending outwardly and upwardly therefrom to prevent logs on said table from falling therefrom.

2. The invention as recited in claim 1, wherein said power transfer means include a reversible hydraulic cylinder connectable to a tractor power system through a manually actuated valve mounted on said frame.

3. The invention as recited in claim 1, wherein said power transfer means include a reversible hydraulic cylinder, an engine mounted on said frame, a hydraulic pump operated by said engine; a manually actuated valve for operating said pump, and a three point hitch frame whereby said splitter is self-contained.

4. The invention as recited in claim 1, wherein said abutment means comprises a push plate extending vertically from said frame and secured to said table.

5. The invention as recited in claim 4, wherein said push plate is about ¾ as high as said blade.

6. The invention as recited in claim 4, further including a square metallic member secured centrally of said push plate and adapted to engage a log so as to provide central in-line thrust even where the ends of the logs are uneven.

* * * * *